US006016987A

United States Patent [19]

Kohnen

[11] Patent Number: 6,016,987

[45] Date of Patent: Jan. 25, 2000

[54] WINDING DEVICE FOR A MATERIAL WEB, ESPECIALLY FOR A REEL SLITTING DEVICE

[75] Inventor: Josef Kohnen, Tonisvorst, Germany

[73] Assignee: Voith Sulzer Finishing GmbH, Krefeld, Germany

[21] Appl. No.: 09/099,104

[22] Filed: Jun. 18, 1998

[30] Foreign Application Priority Data

Jun. 27, 1997 [DE] Germany ..... 197 27 325

[51] Int. Cl.[7] ..... B65H 19/22

[52] U.S. Cl. ..... 242/533.2; 242/596.1; 242/596.5

[58] Field of Search ..... 242/533.2, 533.1, 242/533, 547, 596.5, 596.6, 596.1

[56] References Cited

U.S. PATENT DOCUMENTS

| | | | |
|---|---|---|---|
| 1,869,570 | 8/1932 | Lang | 242/596.1 |
| 3,877,654 | 4/1975 | Randpalu et al. . | |
| 4,460,135 | 7/1984 | Hirakawa et al. . | |
| 4,651,942 | 3/1987 | Tomma . | |
| 4,951,894 | 8/1990 | Young, Jr. et al. | 242/596.1 |
| 5,211,036 | 5/1993 | Engelfried et al. . | |
| 5,257,748 | 11/1993 | Morizzo . | |
| 5,320,297 | 6/1994 | Goerner et al. . | |
| 5,356,087 | 10/1994 | Smith et al. . | |
| 5,551,827 | 9/1996 | Menegatto . | |

FOREIGN PATENT DOCUMENTS

| | | | |
|---|---|---|---|
| 1112392 | 8/1961 | Germany . | |
| 1254451 | 11/1967 | Germany . | |
| 1774847 | 2/1972 | Germany . | |
| 3524648 | 1/1986 | Germany . | |
| 278322 | 5/1990 | Germany | 242/533.2 |
| 4137563 | 10/1979 | Japan | 242/533.1 |
| 5-170363 | 7/1993 | Japan . | |
| 6183617 | 7/1994 | Japan | 242/533.2 |
| 382250 | 11/1964 | Switzerland | 242/596.5 |
| 925823 | 5/1982 | U.S.S.R. | 242/596.5 |

*Primary Examiner*—Donald P. Walsh
*Assistant Examiner*—William A. Rivera
*Attorney, Agent, or Firm*—Greenblum & Bernstein, P.L.C.

[57] ABSTRACT

Winding device for a material web. The winding device includes holding arms and two pivot pins adapted to receive a winding tube. The pivot pins are positioned on the holding arms to face each other and are positionably adjustable to vary a distance therebetween. The winding device also includes a carrying vessel positioned on each holding arm so that the carrying vessels are movable into a transfer position adjacent to the pivot pins. A distance between the carrying vessels is smaller than a distance between the pivot pins at least prior to the winding tube receiving the pivot pins.

27 Claims, 1 Drawing Sheet

WINDING DEVICE FOR A MATERIAL WEB, ESPECIALLY FOR A REEL SLITTING DEVICE

CROSS-REFERENCE TO RELATED APPLICATIONS

The present application claims priority under 35 U.S.C. §119 of German Patent Application No. 197 27 325.4, filed on Jun. 27, 1997, the disclosure of which is expressly incorporated by reference herein in its entirety.

BACKGROUND OF THE INVENTION

1. Field of the Invention

The present invention relates to a winding device for a material web, e.g., a paper web, with a reel slitting device.

2. Discussion of Background Information

Before paper webs are ready for delivery, they must be wound into partial rolls sized for use by the purchaser from so-called jumbo (or parent) rolls that are produced at the exit of the web producing machine or after glazing. In many cases, a winding tube made of, e.g., cardboard, is used as a roll core for these partial rolls. The finished rolls may be produced to have a width of, e.g., approximately 0.4 to 3.8 m, and a diameter of, e.g., approximately 0.3 to 2.0 m.

As noted above, the rolls that are characterized as "finished rolls" are often produced by a paper web that is unwound from the jumbo or parent roll, cut to a desired width, and wound onto the roll core. A jumbo roll generally has a length of web sufficient to produce several finished rolls. In a transition from one finished roll to the next, it is desired to keep expense as low as possible. This is particularly true when the winding device is a component of a reel slitting device because, upon obtaining desired diameters for the finished rolls, a large number of new winding tubes must be supplied to the winding device.

SUMMARY OF THE INVENTION

The present invention provides a device that simplifies the exchange of the rolls in a winding machine.

The present invention provides a winding device for a material web, e.g., a paper web, that may be used in conjunction with a reel slitting device. The winding device includes two pivot pins or trunnions, arranged facing each other on holding arms, for taking up or receiving a winding tube. The distances between the holding arms is adjustable. Further, a carrying vessel is positioned on each holding arm to be displaceable from a receiving position to an exchange position and is positioned adjacent to the pivot pin. The distance between the carrying vessels is smaller than the distance between the pivot pins at least prior to the introduction of the pivot pins into the winding tube.

In a winding device in accordance with the present invention, the winding tubes are held onto the pivot pins during winding and are released after completion of the finished roll by axial movement of the holding arms and the pivot pins, which are fastened thereto. Alternatively, the pivot pins may be retracted, at least partially, into the holding arms, or both arrangements or movements may also be combined. A winding tube for a roll that is to be wound may be positioned on the carrying vessel. Because the carrying vessels have a greater axial distance than the pivot pins on each holding arm, at least prior to the pivot pins insertion into the winding tube, the holding arms may stay axially apart from each other without the winding tube falling from the carrying vessels. Thus, the carrying vessels extend axially beyond the pivot pins. The support dishes may move the winding tubes into a position to be intercepted by the pivot pins during a converging of the holding arms and/or the pivot pins after the holding arms have deposited the finished rolls. In other words, the pivot pins may be introduced, by individual motion and/or with a converging of the holding arms, into the winding tube positioned on the carrying vessel. Thus, the process of transfer is practically completed. Separation of the holding arms and/or retraction of the pivot pins is necessary to release the finished rolls. The converging step is utilized to properly fasten the new winding tube into the winding device. Thereafter, the carrying vessel may be moved into, or returned to, the receiving position so as not to interfere with the subsequent, actual winding process.

In a particular embodiment of the present invention, the holding arms may be swivelled into a release or deposit position from the winding position. In the winding position, the holding arms may stand in a substantially vertical position, and, in the receiving position, the carrying vessel is located adjacent to the swivel point. If the holding arms stand vertically in the winding position, then they are positioned to support the increasing weight of the rolls as the diameter of the rolls expand. The depositing of the finished rolls occurs in another position, so that removal of the finished rolls does not hinder the winding process of a subsequent roll. As the receiving position of the carrying vessel is adjacent to the swivel point, the carrying vessel is able to receive the winding tube of a subsequent roll relatively early on, i.e., particularly under the circumstances in which at least one of the holding arms is in the release position. In this manner, exchange times may be reduced.

The swivel point may be located below, i.e., in a gravitational direction, the pivot pin. Under normal operating conditions, only pressure forces work on the holding arm.

Each holding arm advantageously includes a carrying vessel mechanism that can only be activated if the holding arm is in the winding position. In this manner, it is ensured that transporting of the winding tube can only occur if the holding arms are located in the appropriate position to begin the winding process. Moreover, this embodiment further provides the advantage that the winding tube will remain on the carrying vessel and not fall from movements due to position changes, i.e., swivelling, of the holding arms.

The receiving position may be located adjacent to a lower end of a slanted plane for supplying winding tubes to the carrying vessel. The slanted plane, e.g., when used in conjunction with a reel slitting device, may extend over an entire width of the winding machine. In this manner, individual winding tubes may be supplied to the carrying vessel, or to the pair of carrying vessels, during width changes of individual partial webs and the associate change of the position of the holding arms.

In another particular embodiment, the slanted plane may be provided with a stop latch that enables control of the transfer of the winding tube from the slanted plane to the carrying vessel.

In another embodiment of the present invention, a tube supply device may be positioned at an upper end of the slanted plane. The tube supply device may include a magazine or, alternatively, a transfer car that can be driven to the upper end of the slanted plane. From this position, the winding tube may simply be released onto the slanted plane.

The carrying vessel may be positioned at the receiving region of the holding arms beyond the introduction of the pivot pins to the winding tube. That is, the carrying vessel not only transports the winding tube to the pivot pins, but also simplifies the winding of the material web onto the winding tube at the beginning of the winding process. In other words, the carrying vessel remains in the area of the pivot pins at least a short moment after the winding tube is accepted by the pivot pins to assist in the initial winding of the material web onto the winding tube.

In another embodiment of the present invention, the guide device may be provided as a guide device to work in the area of the edges of the material web. Because it is necessary that the carrying vessel extend axially beyond the extent of the pivot pins, a guide device (strip) that is broad enough to effect the guiding of the material web is provided in the area of edges of the material web. The guide device, e.g., a plate (spoiler) positioned over the material web, then blows the beginning (leading edge) of the material web around the winding roll to initiate the winding process relatively quickly.

At least one of the two pivot pins may be formed and driven as a tensioning spindle. Thus, the winding device is provided as a center wind device. So that the driving power can be transmitted onto the winding tube and thus to the partial roll, an at least non-positive connection is necessary between the pivot pin and the winding tube. This connection is provided via a tensioning spindle with relatively little expense. The tensioning spindle may, be, e.g., pneumatically driven.

Accordingly, the present invention is directed to a winding device for a material web. The winding device includes holding arms and two pivot pins adapted to receive a winding tube. The pivot pins are positioned on the holding arms to face each other and are positionably adjustable to vary a distance therebetween. The winding device also includes a carrying vessel positioned on each holding arm so that the carrying vessels are movable into a transfer position adjacent to the pivot pins. A distance between the carrying vessels is smaller than a distance between the pivot pins at least prior to the winding tube receiving the pivot pins.

In accordance with another feature of the present invention, the holding arms include a common pivot point for swivelably mounting the holding arms, and the holding arms are swivelably positionable into a winding position in which the holding arms are substantially vertically oriented and into a release position in which the carrying vessels are located in a receiving position adjacent the common pivot point. Further, the common swivel point is arranged beneath the pivot pins. Still further, each holding arm includes a carrying vessel mechanism that is actuatable only when the holding arm is located in a winding position.

In accordance with another feature of the present invention, the winding device includes a slanted plane in which a lower end of the slanted plane is positioned adjacent to the receiving position. Further, the slanted plane includes a stop latch. Still further, the winding device includes a winding tube supply device arranged at an upper end of the slanted plane.

In accordance with still another feature of the present invention, the carrying vessels include guide devices for guiding the material web. The guide devices are formed as spoilers.

In accordance with a further feature of the present invention, at least one of the two pivot pins include a tensioning spindle.

In accordance with a still fuither feature of the present invention, the winding device being for use in combination with a reel slitting device.

The present invention is directed to a winding device for winding a material web. The winding device includes first and second support arms swivelingly mounted to a support surface, a first pivot pin coupled to the first support arm, and a second pivot pin coupled to the second support arm. The first and second pivot pins are positioned opposite each other and are axially and independently movable. The winding device also includes at least one carrying device that is movable along at least one of the first and second support arms from a position adjacent the support surface to a position adjacent at least one of the first and second pivot pins.

In accordance with another feature of the present invention, the carrying device has a length that extends at least beyond an axial length of the at least on the first and second pins.

In accordance with another feature of the present invention, the at least one carrying device includes a first carrying device movable along the first support arm from the position adjacent the support surface to a position adjacent the first pivot pin and a second carrying device movable along the second support arm from the position adjacent the support surface to a position adjacent the second pivot pin. The first and second carrying devices have a length that is at least as great as a length of the first and second pivot pins.

In accordance with still another feature of the present invention, the first and second support arms are axially movably coupled to the support surface to adjust a distance between the first and second pivot pins.

In accordance with a further feature of the present invention, the first pivot pin is axially movable with respect to the first support arm and the second pivot pin is axially movable with respect to the second support arm.

In accordance with a still further feature of the present invention, the winding device including a swivelling device that positions at least one of the first and second support arms in a winding position in which the at least one of the first and second support arms is substantially perpendicular to the support surface and a receiving position in which the at least one of the first and second support arms is substantially parallel to the support surface. Further, in the receiving position, the at least one carrying device is positioned adjacent to the support surface.

In accordance with another feature of the present invention, the winding device including a winding tube supplying device and a slanted plane having an upper end and a lower end. The slanted tube is adapted to transport a winding tube from the winding tube supplying device to the at least one carrying device in the receiving position.

In accordance with still another feature of the present invention, the at least one carrying device is adapted to move along the at least one of the first and second support arms only when the at least one of the first and second support arms is positioned substantially perpendicular to the support surface.

In accordance with still another feature of the present invention, the first and second pivot pins are adapted to be inserted into a winding tube. Further, at least one of the first and second pivot pins include a driving pin adapted to rotate the winding tube. Still further, the driving pin includes a tensioning spindle.

In accordance with a still further feature of the present invention, the winding device includes a guide element coupled to the at least one carrying device that is adapted to guide the material web around a winding tube.

In accordance with yet another feature of the present invention, the at least one carrying device is adapted to hold the winding tube in the position adjacent the first and second pivot pins while the first and second pivot pins are inserted into the winding tube. Further, the at least one carrying device is adapted to return to the position adjacent the support surface after the first and second pivot pins have been inserted into the winding tube.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 2:
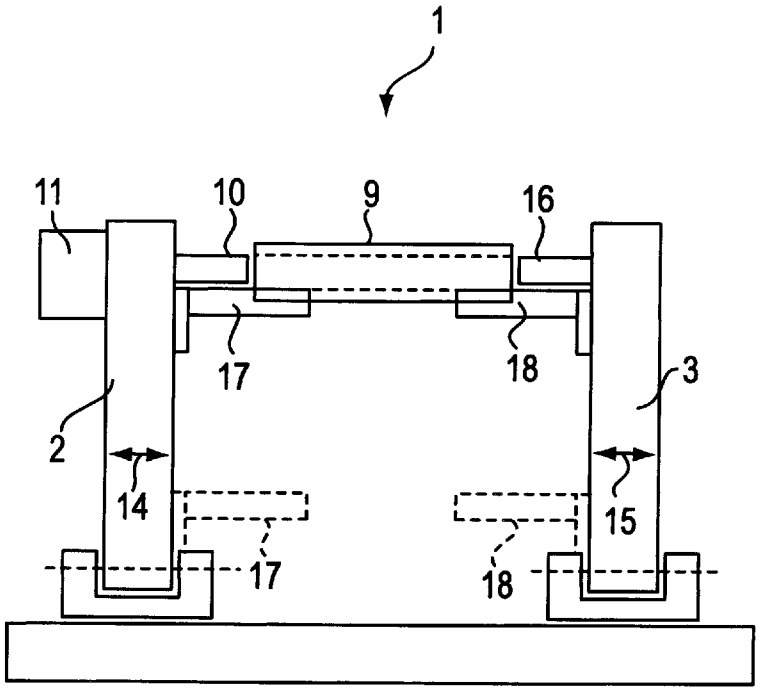
FIG. 2 illustrates a schematic front-view of the winding device of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention as described herein discusses winding a material web, e.g., a paper web, into finished rolls. However, it is noted that the present invention is not limited to paper webs, and that the features of the present invention may be utilized by the ordinarily skilled artisan with many other material webs and similar products.

A winding device 1 includes two holding arms 2 and 3 that are swivelably mounted to a floor 6. In this manner, holding arms 2 and 3 are swivelably movable to a position for discharging a wound roll 5 onto floor 6, e.g., as depicted in dashed lines in FIG. 1, from a substantially vertical position for winding a wound roll 5, e.g., as depicted in solid lines in FIG. 1. A swivel mechanism 4 may be provided to impart the swiveling movement onto holding arms 2 and 3 around swivel or pivot points 8 so that a center point of wound roll 5 moves along double arrow 7.

Roll 5 includes a winding tube 9 utilized as a roll core. During winding, winding tube 9 is spun (rotated) via a pivot pin (or trunnion) in the form of, e.g., a tensioning spindle 10 coupled to a rotational attachment 11 to pull a material web 12 onto itself. A press roll 13 is positioned adjacent a peripheral surface of roll 5 to provide controlled expansion of roll 5.

Both holding arms 2 and 3 can be moved in the directions indicated by double arrows 14 and 15, i.e., axially with respect to winding tube 9. Holding arms 2 and 3 may be individually driven, particularly when winding device 1 utilized with a reel slitting device 23. Thus, in addition to axial position, the distance between holding arms 2 and 3 is also adjustable so that rolls having various or different widths can be wound.

Holding arm 3 includes a pivot pin 16 arranged or oriented facing tensioning spindle 10. Tensioning spindle 10 and pivot pin 16 can be introduced or inserted into winding tube 9 from opposing directions, e.g., by moving holding arms 2 and 3 toward each other. Further, pivot pin 16 can be designed and driven as a tensioning spindle.

A carrying vessel 17 is positioned on holding arm 2 and a carrying vessel 18 is positioned on holding arm 3. Both carrying vessels 17 and 18 are movable from a lower position (depicted in dashed lines) to an upper position (depicted in solid lines) via a moving or transport mechanism (not depicted in detail) formed by, e.g., a spindle system.

Figure 1:
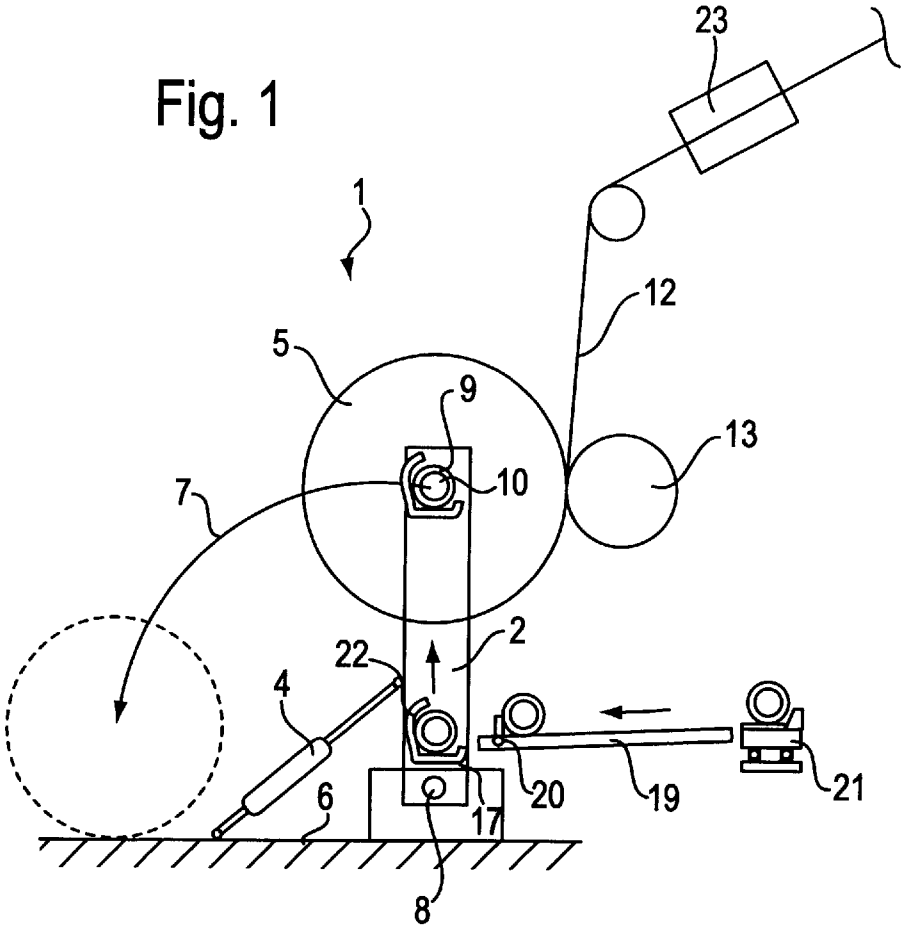
FIG. 1 illustrates a schematic side-view of a winding device according to the present invention.

The lower position for carrying vessels 17 and 18 is located near swivel point 8 (see FIG. 1) to serve as a receiving position. In the receiving position, winding tube 9 can be rolled into carrying vessels 17 and 18 from a slanted plane 19. Slanted plane 19 may be provided with a stop latch 20 to hold winding tube 9 in place prior to being rolled into carrying vessels 17 and 18. In FIG. 1, several winding tubes are depicted in various positions of winding device 1 to illustrate the various stages of the winding procedure. Another winding tube is exemplarily depicted on a transport slide (or cradle) 21 located at an upper end of slanted plane 19 to supply winding tubes to winding device 1.

Carrying vessels 17 and 18 have an axial length greater than that of tensioning spindle 10 and pivot pin 16 so as to project beyond the axial extent of tensioning spindle 10 and pivot pin 16. In this manner, it is possible to lie winding tube 9 within carrying vessels 17 and 18 and to move winding tube 9, via carrying vessels 17 and 18, from the receiving position to a transfer position (i.e., upper position), without interference or hindrance from tensioning spindle 10 and pivot pin 16. Once carrying vessels 17 and 18 have been positioned in the transfer position, then holding arms 2 and 3 can be axially moved toward each other to drive tensioning spindle 10 and pivot pin 16 into winding tube 9. As tensioning spindle 10 and pivot pin 16 are driven or guided into winding tube 9, winding tube 9 may glide over axially moving carrying vessels 17 and 18. When winding tube 9 has been loaded between holding arms 2 and 3, i.e., on tensioning spindle 10 and pivot pin 16, carrying vessels 17 and 18 may be moved downward toward the receiving position.

In the exemplary illustration of FIG. 1, carrying vessel 17 is depicted as having an extension on a supply side of material web 12 that forms a guide device 22. Guide device 22 may be, e.g., a plate (spoiler) positioned above material web 12 that is utilized to simplify the guiding of material web 12 around winding tube 9 so that the winding procedure may begin almost automatically, e.g., by blowing the leading edge of material web 12 around winding tube 9.

If carrying vessels 17 and 18 are formed to include guide devices 22, then carrying vessels 17 and 18 may remain in the transfer (upper) position until after the winding process has begun. Thereafter, they may be lowered to the receiving position. Further, if necessary, guide device 22 can be collapsed so that they do not interfere with winding tube 9 during retraction of carrying vessels 17 and 18. However, if guide devices 22 are not provided, then carrying vessels 17 and 18 may be lowered to the receiving position as early as when winding tube 9 is hung between tensioning spindle 10 and pivot pin 16.

The mechanism for driving or transporting carrying vessels 17 and 18 can be formed so that carrying vessels 17 and 18 can only be moved into the transfer position, i.e., from the receiving position, when holding arms 2 and 3 are positioned in the winding position, i.e., substantially vertical. It is substantially guaranteed that, in the winding position, winding tube 9 will not fall out of carrying vessels 17 and 18 because they are closed below and practically open only upward.

The transfer or winding of material web 12 onto a new roll goes relatively quickly via the depicted winding device 1. As soon as a roll 5 is finished winding, holding arms 2 and 3 swivel or swing around pivot 8 to deposit roll 5 onto floor 6. As soon as the roll is supported on floor 6, holding arms 2 and 3 are axially moved apart to release roll 5. In the separated state, holding arms 2 and 3 may be swivelled back into the vertical (winding) position. Carrying vessels 17 and 18, located in the receiving position, may receive a new winding tube 9 from slanted plane 19, and may be driven or transported to the receiving position. As soon as winding tube 9 has reached the receiving position, holding arms 2 and 3 may converge and begin the winding procedure again.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A winding device for a material web comprising:

holding arms;

two pivot pins adapted to receive a winding tube, the pivot pins being positioned on the holding arms to face each other and being positionably adjustable to vary a distance therebetween; and a carrying vessel positioned on each holding arm for transferring the winding tube, the carrying vessels being movable into a transfer position adjacent to the pivot pins to transfer the winding tube, wherein a distance between the carrying vessels is smaller than a distance between the pivot pins at least prior to the winding tube receiving the pivot pins.

2. The winding device in accordance with claim 1, the holding arms comprising a common pivot point for swivelably mounting the holding arms; and the holding arms being swivelably positionable into a winding position in which the holding arms are substantially vertically oriented and into a release position in which the carrying vessels are located in a receiving position adjacent the common pivot point.

3. The winding device in accordance with claim 2, wherein the common swivel point is arranged beneath the pivot pins.

4. The winding device in accordance with claim 2, each holding arm comprising a carrying vessel mechanism that is actuatable only when the holding arm is located in a winding position.

5. The winding device in accordance with claim 2, further comprising a slanted plane, a lower end of the slanted plane being positioned adjacent to the receiving position.

6. The winding device in accordance with claim 5, the slanted plane comprising a stop latch.

7. The winding device in accordance with claim 5, further comprising a winding tube supply device being arranged at an upper end of the slanted plane.

8. The winding device in accordance with claim 1, the carrying vessels comprising guide devices for guiding the material web.

9. The winding device in accordance with claim 8, the guide devices being formed as a spoiler.

10. The winding device in accordance with claim 1, at least one of the two pivot pins comprising a tensioning spindle.

11. The winding device in accordance with claim 1, the winding device for use in combination with a reel slitting device.

12. The winding device in accordance with claim 1, the carrying vessel positioned on each holding arm being movable along the each holding arm.

13. A winding device for winding a material web comprising:

first and second support arms swivelingly mounted to a support surface;

a first pivot pin coupled to the first support arm;

a second pivot pin coupled to the second support arm;

the first and second pivot pins being positioned opposite each other and being axially and independently movable; and at least one carrying device for transferring a winding tube, the at least one carrying device being movable along at least one of the first and second support arms from a position adjacent the support surface to a position adjacent at least one of the first and second pivot pins to transfer the winding.

14. The winding device in accordance with claim 13, the carrying device having a length that extends at least beyond an axial length of the at least one of the first and second pins.

15. The winding device in accordance with claim 14, the first pivot pin being axially movable with respect to the first support arm and the second pivot pin being axially movable with respect to the second support arm.

16. The winding device in accordance with claim 13 the at least one carrying device comprising a first carrying device movable along the first support arm from the position adjacent the support surface to a position adjacent the first pivot pin and a second carrying device movable along the second support arm from the position adjacent the support surface to a position adjacent the second pivot pin; and the first and second carrying devices have a length that is at least as great as a length of the first and second pivot pins.

17. The winding device in accordance with claim 13, the first and second support arms being axially movably coupled to the support surface to adjust a distance between the first and second pivot pins.

18. The winding device in accordance with claim 13, further comprising:

a swivelling device that positions at least one of the first and second support arms in a winding position in which the at least one of the first and second support arms is substantially perpendicular to the support surface and a receiving position in which the at least one of the first and second support arms is substantially parallel to the support surface.

19. The winding device in accordance with claim 18, wherein, in the receiving position, the at least one carrying device is positioned adjacent to the support surface.

20. The winding device in accordance with claim 13, further comprising:

a winding tube supplying device;

a slanted plane having an upper end and a lower end; and the slanted tube being adapted to transport a winding tube from the winding tube supplying device to the at least one carrying device in the receiving position.

21. The winding device in accordance with claim 13, the at least one carrying device being adapted to move along the at least one of the first and second support arms only when the at least one of the first and second support arms is positioned substantially perpendicular to the support surface.

22. The winding device in accordance with claim 13 the first and second pivot pins being adapted to be inserted into a winding tube.

23. The winding device in accordance with claim 22, at least one of the first and second pivot pins comprising a driving pin that is adapted to rotate the winding tube.

24. The winding device in accordance with claim 23, the driving pin comprising a tensioning spindle.

25. The winding device in accordance with claim 22, further comprising a guide element coupled to the at least one carrying device adapted to guide the material web around a winding tube.

26. The winding device in accordance with claim 22, the at least one carrying device being adapted to hold the winding tube in the position adjacent the first and second pivot pins while the first and second pivot pins are inserted into the winding tube.

27. The winding device in accordance with claim 26, the at least one carrying device being adapted to return to the position adjacent the support surface after the first and second pivot pins have been inserted into the winding tube.

* * * * *